US010648663B2

(12) United States Patent
Chang

(10) Patent No.: US 10,648,663 B2
(45) Date of Patent: May 12, 2020

(54) TURBOCHARGED BURNER

(71) Applicant: PURE METHANOL ENERGY TECHNOLOGY CO., LTD., New Taipei (TW)

(72) Inventor: Teng-Yun Chang, New Taipei (TW)

(73) Assignee: Pure Methanol Energy Technology Co., Ltd., New Taipei (TW)

( * ) Notice: Subject to any disclaimer, the term of this patent is extended or adjusted under 35 U.S.C. 154(b) by 174 days.

(21) Appl. No.: 15/906,265

(22) Filed: Feb. 27, 2018

(65) Prior Publication Data

US 2019/0186735 A1 Jun. 20, 2019

(30) Foreign Application Priority Data

Dec. 15, 2017 (TW) ..... 106144280 A

(51) Int. Cl.

| | |
|---|---|
| ***F23D 5/18*** | (2006.01) |
| ***F23L 9/00*** | (2006.01) |
| ***F23N 3/08*** | (2006.01) |
| ***F23D 11/00*** | (2006.01) |
| ***F23L 5/02*** | (2006.01) |

(52) U.S. Cl.

CPC ..... *F23L 9/00* (2013.01); *F23D 5/18* (2013.01); *F23D 11/001* (2013.01); *F23L 5/02* (2013.01); *F23N 3/087* (2013.01); *F23N 2221/04* (2020.01); *F23N 2237/16* (2020.01)

(58) Field of Classification Search

CPC ..... F23L 9/00
USPC ..... 431/187
See application file for complete search history.

(56) References Cited

U.S. PATENT DOCUMENTS 2,174,818 A * 10/1939 Brace ..... F23D 3/40 431/262
2,971,577 A * 2/1961 Wallace ..... F23D 14/36 239/417.3
3,056,398 A * 10/1962 Kirk ..... F23N 1/005 126/110 R
3,094,979 A * 6/1963 Volbehr ..... B60H 1/2203 126/110 R
4,613,072 A * 9/1986 Kikuchi ..... B60H 1/2209 237/12.3 C (Continued)

FOREIGN PATENT DOCUMENTS

JP H01219404 A 9/1989
JP 2013231374 A 11/2013

OTHER PUBLICATIONS

Patent Search and Examination Report Issued by a Foreign Patent Office for Application No. GB1806613.4.

*Primary Examiner* — Avinash A Savani
(74) *Attorney, Agent, or Firm* — Rosenberg, Klein & Lee

(57) ABSTRACT

A turbocharged burner has a burning unit and a turbocharger. The burning unit is installed with a fuel bucket for storing fuel and a burning chamber having a tubular shape, and interior of the burning chamber is installed with at least one nozzle. At least one fuel tube coupled to the fuel bucket is disposed at each nozzle, and the turbocharger is coupled to the burning chamber. Under the reaction of the turbocharger, the gas fluid of the burning chamber is increased, a flowing speed and a flowing flux of the gas fluid are increased, and thus the burning further entirely achieves the objective of increasing fuel burning efficiency.

12 Claims, 8 Drawing Sheets

(56) References Cited

U.S. PATENT DOCUMENTS

| | | | | |
|---|---|---|---|---|
| 5,277,578 | A * | 1/1994 | Ratnani | F23C 7/06 431/173 |
| 2012/0322012 | A1 | 12/2012 | Tsumagari et al. | |
| 2013/0004297 | A1 * | 1/2013 | Sheridan | F02C 7/36 415/122.1 |
| 2013/0160431 | A1 | 6/2013 | Tsumagari | |
| 2015/0082777 | A1 | 3/2015 | Tsumagari et al. | |
| 2015/0121857 | A1 | 5/2015 | Tsumagari et al. | |
| 2015/0184565 | A1 | 7/2015 | Shibuya et al. | |
| 2015/0204223 | A1 | 7/2015 | Tsumagari et al. | |

* cited by examiner

TURBOCHARGED BURNER

BACKGROUND

1. Technical Field

The present disclosure relates to a burner, in particular to a turbocharged burner for efficiently increasing the burning efficiency.

2. Description of Related Art

According to prior art, the burner is widely used in a boiler, a heating furnace, a drying equipment and an industrial furnace and other thermal machinery, and the basic architecture of the conventional burner is shown as FIG. 1. The conventional burner is installed with a burning chamber 12 coupled to a fan 11, and interior of the burning chamber 12 is installed with a plurality of nozzles 13 coupled to a fuel providing device (not shown in the drawings). Mainly, the fan 11 generates the accelerating gas fluid in the burning chamber 12, and after the fuel injected into the burning chamber 12 is fired, accompanying the gas fluid in the burning chamber 12, the fire can be spurted and burned at the front end of the burning chamber 12.

The fuel of the conventional burner is mostly the diesel with good ignitability. Currently, there is also a burner provided as follows. After the burner utilizes a heater to heat the heavy oil to the high temperature of 110 degrees Celsius, the high-pressure pump transfers the heated heavy oil to the firing position via the pipeline, and thus the heavy oil can be the fuel. The most applications of the burners currently are applied thermal machineries and applied heat exchange devices, both of which are couple to the front ends of the burning chambers 12 of the burner, and thus the used fuel burning efficiencies are entirely determined according to whether the supplying oxygen of the burning chamber 12 is sufficient.

Though the similar conventional burner can use the fan to generate the accelerating gas fluid, to obtain the sufficient supplying oxygen, the generated accelerating gas fluid by the fan 11 must be entirely introduced into the interior of the burning chamber 12. The volumes of the fan 11 and the burning chamber 12 are very different, and the fan 11 and the burning chamber 12 must be arranged in parallel. Thus, the related devices or units are easy to be affected due to the high operation temperatures, and the related devices or units may be failed or damaged. In particular, the shapes of the fan 11 and the burning chamber 12 are not easy to be integrated, and this limits the miniature and compacting development of the burner.

SUMMARY

According to one of objectives of the present disclosure, the present disclosure provides a turbocharged burner for efficiently increasing the burning efficiency.

The present disclosure provides a turbocharged burner which at least comprises: a burning unit and a turbocharger; wherein the burning unit is installed with a fuel bucket for storing fuel and a burning chamber having a tubular shape, interior of the burning chamber is installed with at least one nozzle, at least one fuel tube coupled to the fuel bucket is disposed at each the nozzle; and the turbocharger is coupled to the burning chamber.

Accordingly, under the reaction of the turbocharger, the turbocharged burner increases the gas fluid of the burning chamber, accelerates the flowing speed of the gas fluid, and enhances the flowing flux of the gas fluid, so as to make the burning further entirely achieve the objective of increasing fuel burning efficiency.

According to the above feature, wherein the turbocharger is disposed at a rear end of the burning chamber, and a wind blowing direction of the turbocharger is parallel to an axis of the burning chamber; and the turbocharged burner further comprises a wind speed auxiliary unit, the wind speed auxiliary unit is installed with a wind speed bucket at least covering exterior of the turbocharger, a front end and a rear end of the wind speed bucket are open, a gap for providing passage of a gas fluid is formed between the wind speed bucket and the turbocharger, the rear end of the wind speed bucket is installed with a blade and a motor for driving the blade to spin.

Accordingly, further under the reaction of the wind speed auxiliary unit, partial flowing fluid is accelerated to pass the gap between the wind speed bucket and the turbocharger, so as to increase the waste heat emission rates of the turbocharger and the motor. Thus, relatively positive and reliable means are provided to prevent the related device and unit from being affected by the high temperature.

According to the above features, the turbocharged burner further comprises a control unit; the control unit is installed with a control circuit, a lighter correspondingly disposed in the interior of the burning chamber and a fuel pump coupled to the fuel tube of each the nozzle, the control circuit is at least electrically connected to the lighter, the fuel pump, the turbocharger and the motor of the wind speed auxiliary unit.

According to the above features, the turbocharged burner further comprises: a high-pressure gas supplying unit and a control unit; the high-pressure gas supplying unit is installed with a gas storage bucket for storing a high-pressure gas, and each the nozzle is installed with a high-pressure pipe coupled to the gas storage bucket; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle, the turbocharger and the motor of the wind speed auxiliary unit.

According to the above features, the burning unit is installed with at least one jet pipe disposed at a front end of the burning chamber, and a pipe diameter of each the jet pipe is less than an inner diameter of the burning chamber.

According to the above features, the turbocharged burner further comprises a control unit; the control unit is installed with a control circuit, a lighter correspondingly disposed in the interior of the burning chamber and a fuel pump coupled to the fuel tube of each the nozzle, the control circuit is at least electrically connected to the lighter, the fuel pump, the turbocharger and the motor of the wind speed auxiliary unit; and the burning unit is installed with at least one jet pipe disposed at a front end of the burning chamber, and a pipe diameter of each the jet pipe is less than an inner diameter of the burning chamber.

According to the above features, the turbocharged burner further comprises a high-pressure gas supplying unit and a control unit; the high-pressure gas supplying unit is installed with a gas storage bucket for storing a high-pressure gas, and each the nozzle is installed with a high-pressure pipe coupled to the gas storage bucket; the control unit is installed with a control circuit, a lighter correspondingly disposed in the interior of the burning chamber, a fuel pump coupled to the fuel tube of each the nozzle and a throttle coupled to the high-pressure pipe of each the nozzle, the control circuit is at least electrically connected to the lighter, the fuel pump, the throttle, the turbocharger and the motor of the wind speed auxiliary unit; and the burning unit is installed with at least one jet pipe disposed at a front end of the burning chamber, and a pipe diameter of each the jet pipe is less than an inner diameter of the burning chamber.

According to the above features, the wind speed auxiliary unit is installed with a lubricant bucket for storing a lubricant and at least one lubricant pipe coupled to the lubricant bucket and a pivot setting location on a rotating axis of the motor.

According to the above features, the wind speed auxiliary unit is installed with at least one hatch cover disposed at a tubular side of the wind speed bucket, wherein the hatch cover is capable of opening and closing.

According to the above features, the wind speed auxiliary unit is installed with a lubricant bucket for storing a lubricant, at least one lubricant pipe coupled to the lubricant bucket and a pivot setting location on a rotating axis of the motor and at least one hatch cover disposed at a tubular side of the wind speed bucket, wherein the hatch cover is capable of opening and closing.

According to the above features, the high-pressure gas supplying unit is further installed with an air compressor coupled to the gas storage bucket, and the air compressor is electrically connected to the control circuit of the control unit.

According to the above features, the high-pressure gas supplying unit is further installed with an air compressor coupled to the gas storage bucket, and the air compressor is electrically connected to the control circuit of the control unit; and the wind speed auxiliary unit is installed with a lubricant bucket for storing a lubricant and at least one lubricant pipe coupled to the lubricant bucket and a pivot setting location on a rotating axis of the motor.

According to the above features, the high-pressure gas supplying unit is further installed with an air compressor coupled to the gas storage bucket, and the air compressor is electrically connected to the control circuit of the control unit; and the wind speed auxiliary unit is installed with at least one hatch cover disposed at a tubular side of the wind speed bucket, wherein the hatch cover is capable of opening and closing.

According to the above features, the high-pressure gas supplying unit is further installed with an air compressor coupled to the gas storage bucket, and the air compressor is electrically connected to the control circuit of the control unit; the wind speed auxiliary unit is installed with a lubricant bucket for storing a lubricant, at least one lubricant pipe coupled to the lubricant bucket and a pivot setting location on a rotating axis of the motor and at least one hatch cover disposed at a tubular side of the wind speed bucket, wherein the hatch cover is capable of opening and closing.

Under the reaction of the turbocharger, the turbocharged burner disclosed by the present disclosure can increase the gas fluid of the burning chamber, accelerate the flowing speed of the gas fluid, and enhance the flowing flux of the gas fluid, so as to make the burning further entirely achieve the objective of increasing fuel burning efficiency. Moreover, by utilizing the design of the high-pressure gas supplying unit and the jet pipe, relatively positive and reliable means are provided to increase the burning efficiency and thermal energy of the fuel. In addition to reduce the contaminants generated by burning the diesel and heavy oil, it eases the alcohol to be the fuel, such that the turbocharged burner can be used in the restaurant, office, school and other indoor environment.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
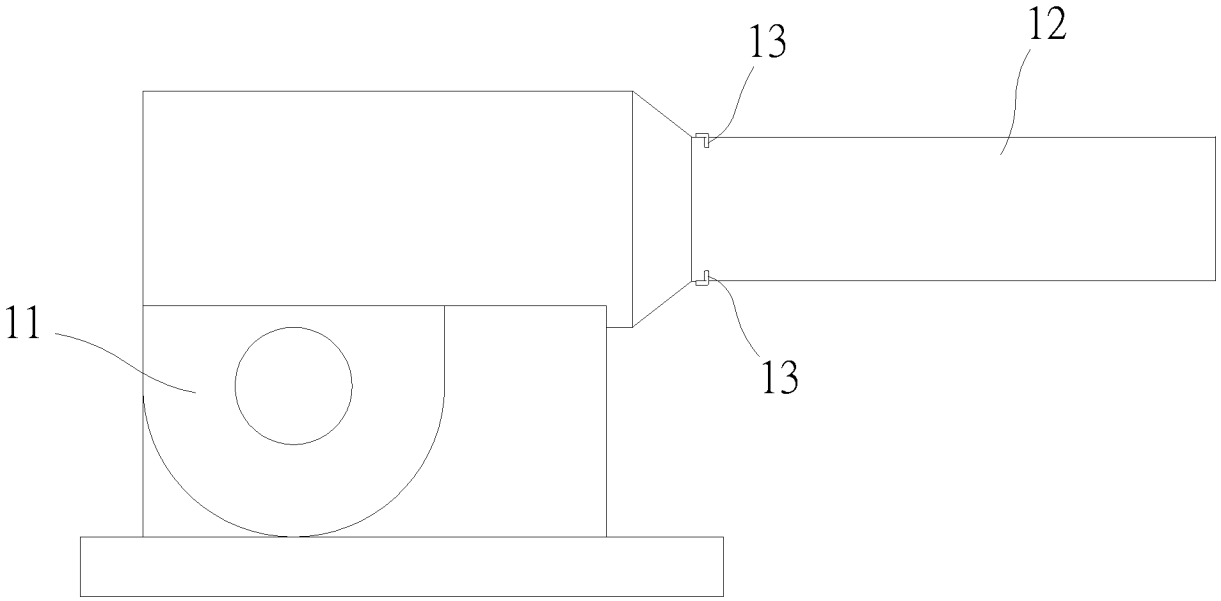
FIG.1 Prior Art
FIG. 1 is architecture diagram of a conventional burner.
Figure 2:
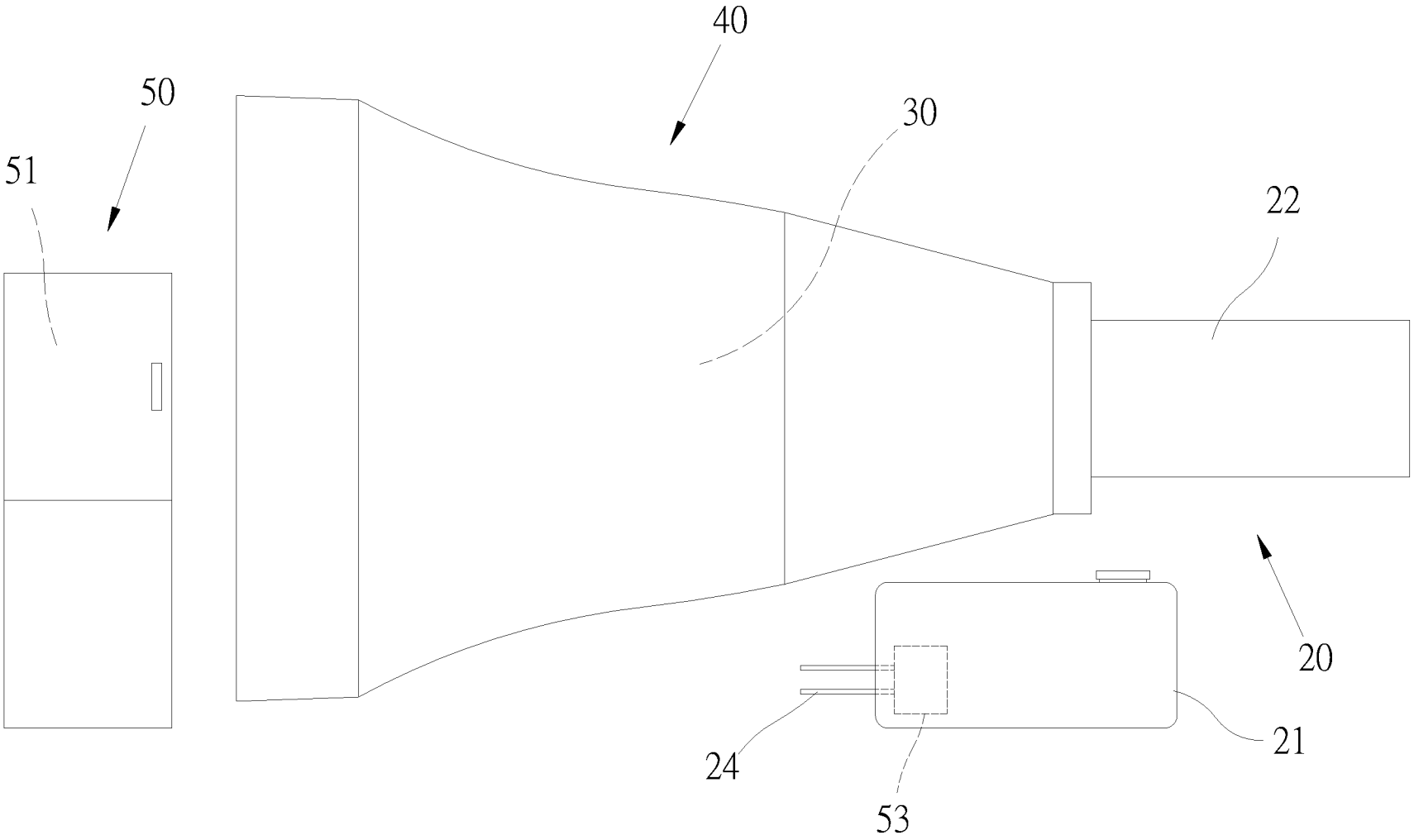
FIG. 2 is a basic architecture diagram of a turbocharged burner according to a first embodiment of the present disclosure.
Figure 3:
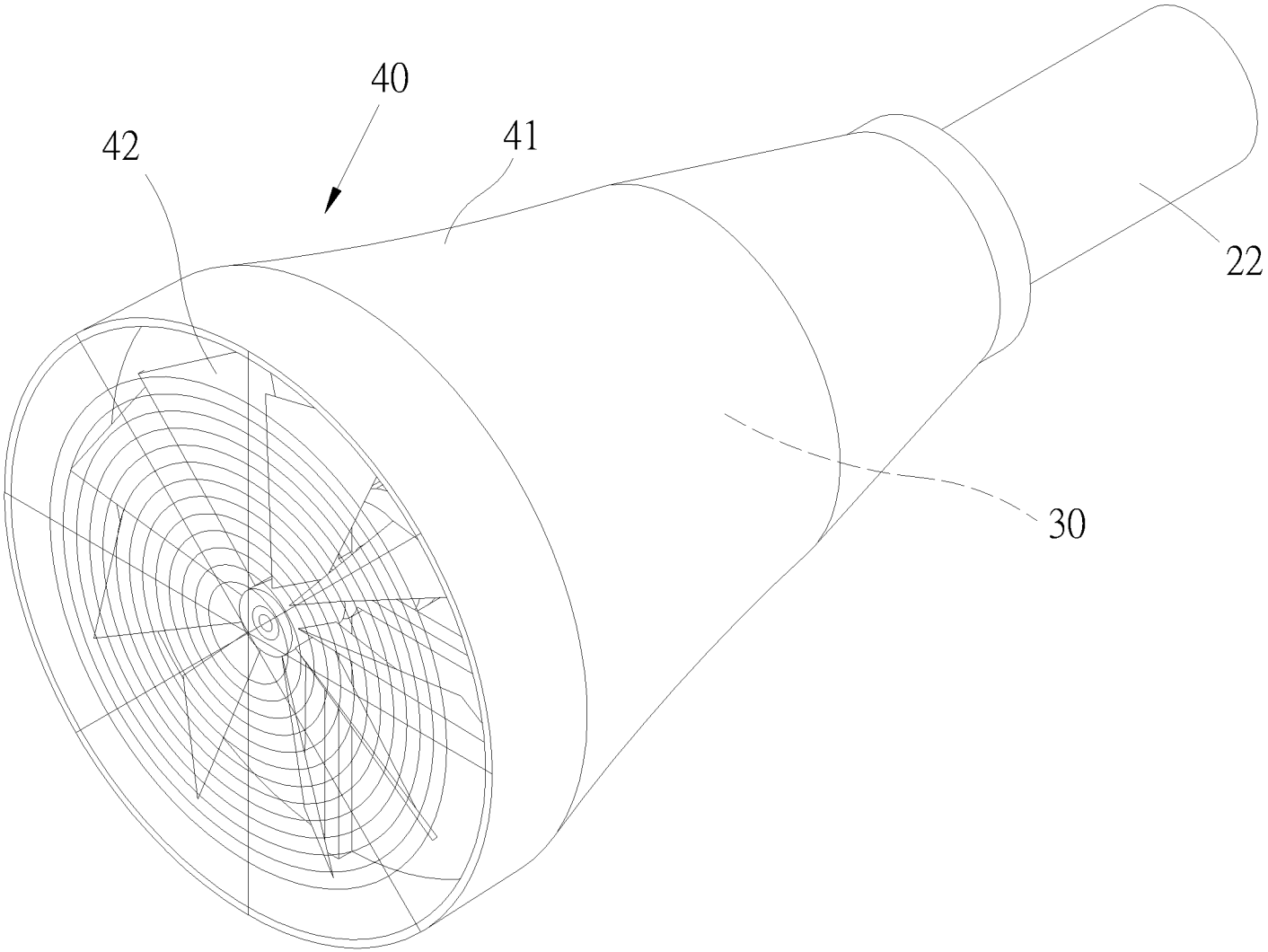
FIG. 3 is a three-dimensional outline diagram of a burning chamber and a wind speed auxiliary unit according to a first embodiment of the present disclosure.
Figure 4:
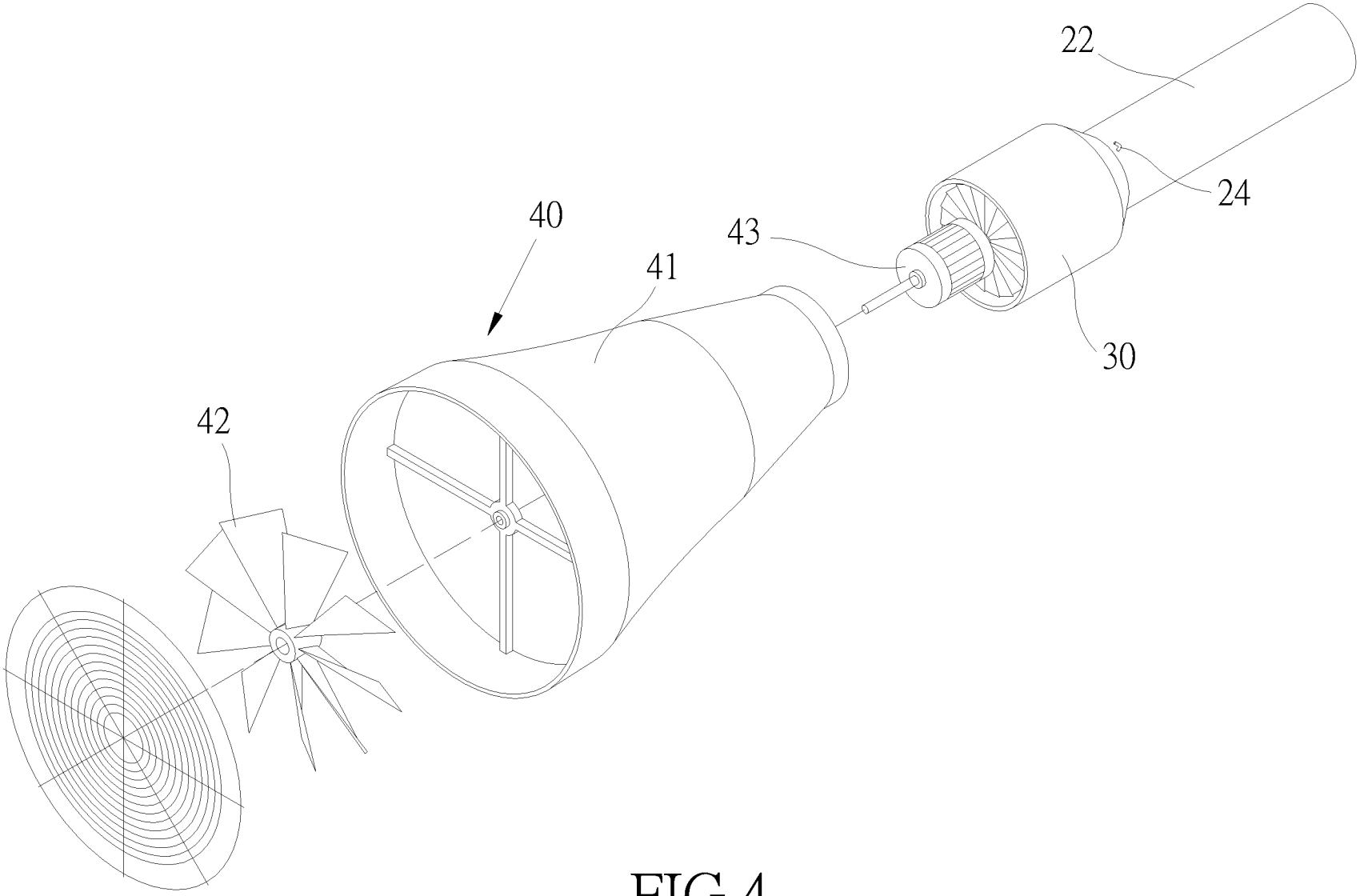
FIG. 4 is an exploding architecture diagram of a wind speed auxiliary unit according to a first embodiment of the present disclosure.
Figure 5:
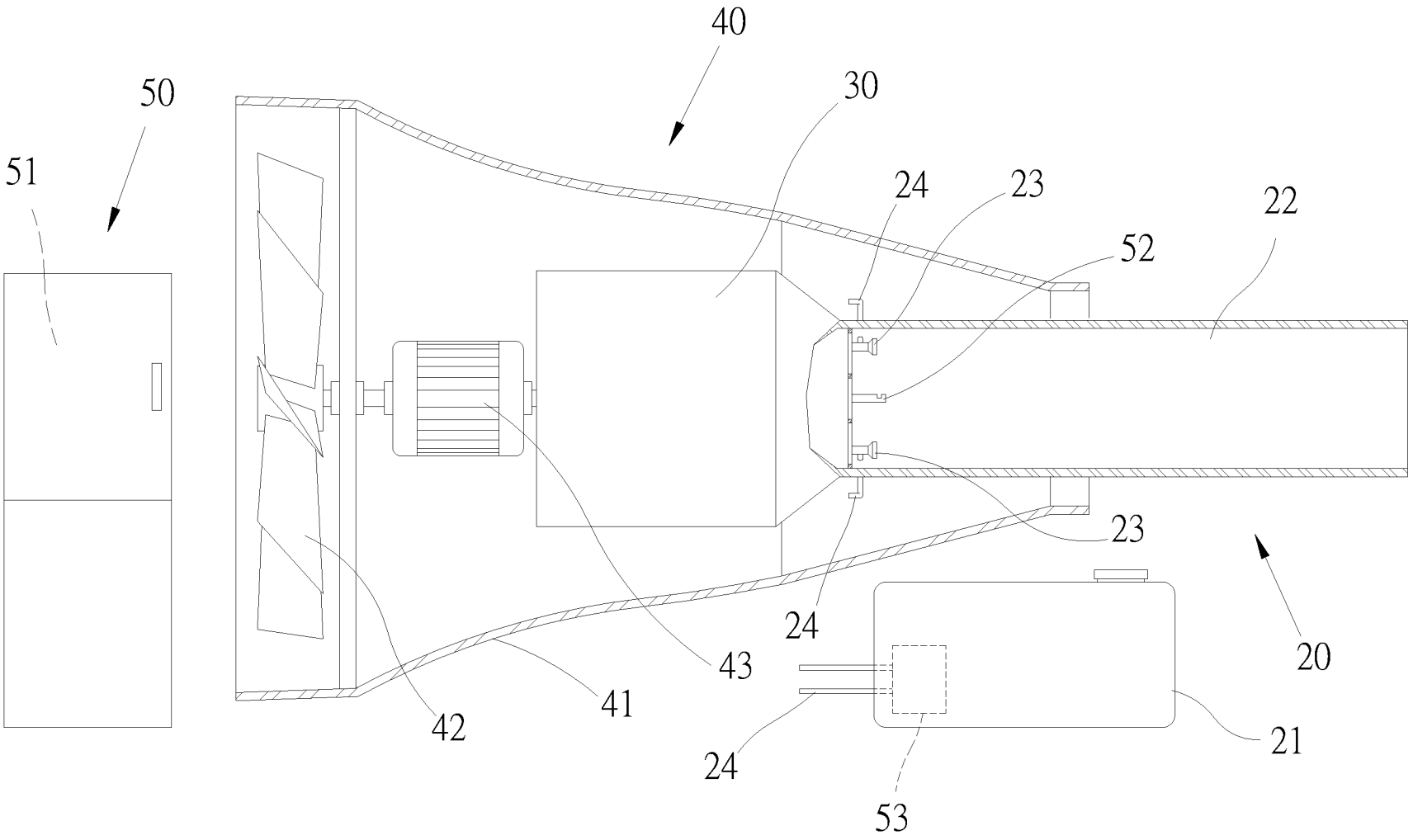
FIG. 5 is a sectional architecture diagram of a turbocharged burner according to a first embodiment of the present disclosure.

The present disclosure provides a turbocharged burner capable of efficiently increasing and accelerating the gas fluid and preventing the related device and unit from being affected by the high temperature, and as shown in FIG. 2 through FIG. 5, the turbocharged burner of the present disclosure basically at least comprises a burning unit 20 and a turbocharger 30.

The burning unit 20 is installed with a fuel bucket 21 for storing fuel and a burning chamber 22 having a tubular shape, interior of the burning chamber 22 is installed with at least one nozzle 23, and at least one fuel tube 24 coupled to the fuel bucket 21 is disposed at each the nozzle 23. Preferably, the interior of the burning chamber 22 is installed with a plurality of the nozzles 23.

The turbocharger 30 is coupled to the burning chamber 22, such that the gas fluid is boosted by the turbocharger 30 and then provided to the burning chamber 22. In one embodiment, the turbocharger 30 is disposed at a rear end of the burning chamber 22, and a wind blowing direction of the turbocharger 30 is parallel to an axis of the burning chamber 22; alternatively, in another one embodiment, turbocharger 30 is coupled to the burning chamber 22 through a pipeline (not shown in the drawings), and the pipeline communicates with the turbocharger 30 and the burning chamber 22, such that the gas fluid is boosted by the turbocharger 30 and then provided to the burning chamber 22. In the actual implementation, the turbocharger 30 is preferably disposed on the axis of the burning chamber 22.

Accordingly, under the reaction of the turbocharger 30, the turbocharged burner increases the gas fluid of the burning chamber 22, accelerates the flowing speed of the gas fluid, and enhances the flowing flux of the gas fluid, so as to make the burning further entirely achieve the objective of increasing fuel burning efficiency.

The turbocharged burner further comprises a wind speed auxiliary unit 40. The wind speed auxiliary unit 40 is installed with a wind speed bucket 41 at least covering exterior of the turbocharger 30, a front end and a rear end of the wind speed bucket 41 are open, and a gap for providing passage of a gas fluid is formed between the wind speed bucket 41 and the turbocharger 30. The rear end of the wind speed bucket 41 is installed with a blade 42 and a motor 43 for driving the blade 42 to spin.

Figure 6:
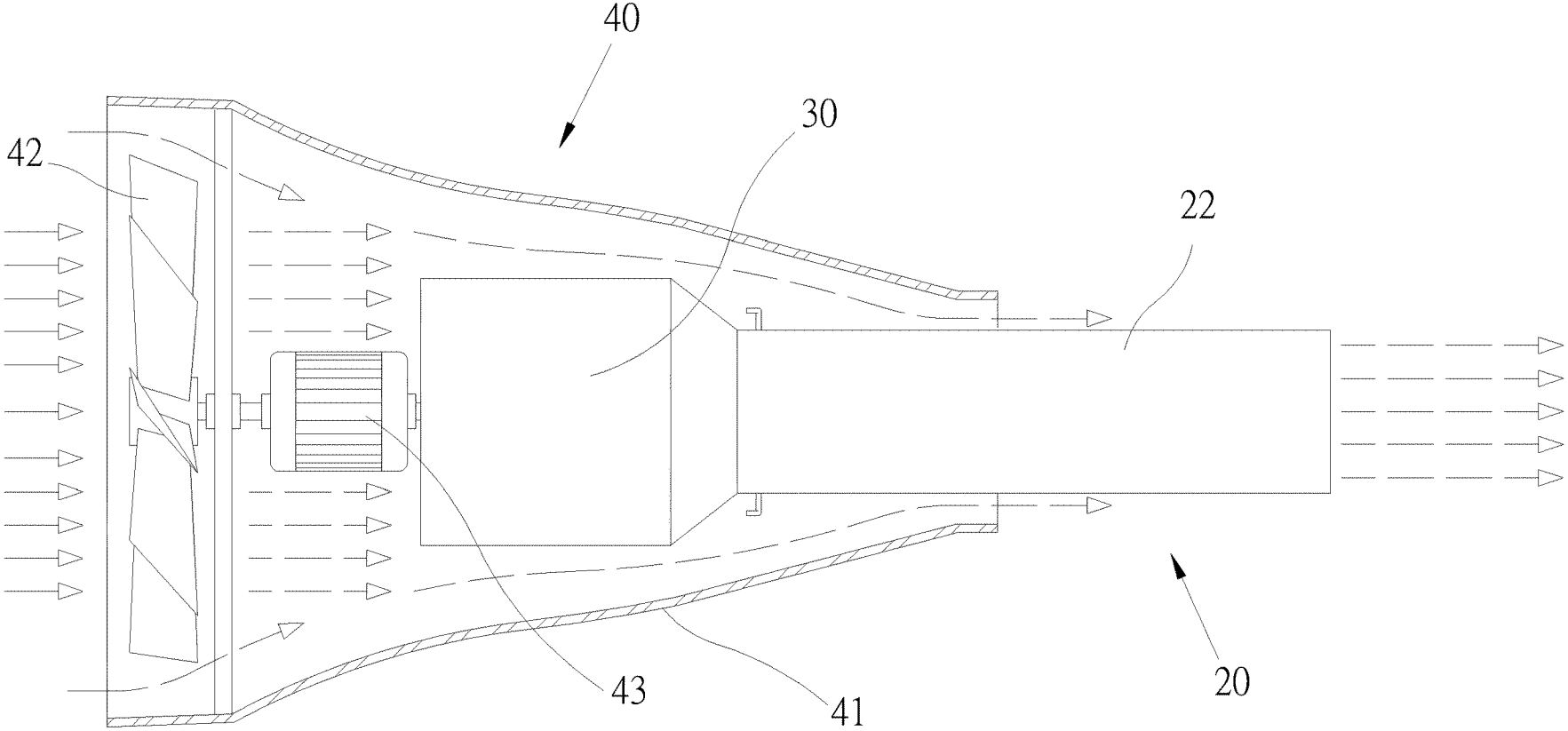
FIG. 6 is an operation diagram of a turbocharged burner according to a first embodiment of the present disclosure.

Principally, when the turbocharged burner is operating, under the reaction of the turbocharger 30, the accelerated gas fluid is generated in the interior of the burning chamber 22. After the fuel injected into the interior of the burning chamber 22, as shown in FIG. 6, accompanying with the accelerated gas fluid in the interior of the burning chamber 22, the fire is spurted and burning at the front end of the burning chamber 22.

In particular, under the reaction of operating the wind speed auxiliary unit 40 and the blade 42, the gas fluid of the turbocharger 30 is increased, and not only the flowing speed and the flowing flux of the gas fluid are increased, but also the partial flowing fluid is accelerated to pass through the gap between the wind speed bucket 41 and the turbocharger 30. Therefore, the waste heat emission rates of the turbocharger 30 and the motor 43 are increased, and relatively positive and reliable means are provided to prevent the related device and unit from being affected by the high temperature.

It is noted that, since the turbocharged burner of the present disclosure can increase the flowing speed and the flowing flux of the gas fluid under the reaction of the wind speed auxiliary unit 40, the size of the fan can be reduced. Even, by utilizing the design that the turbocharger 30 is disposed on the axis of the burning chamber 22, the shapes of the burning chamber 22, the turbocharger 30 and the wind speed auxiliary unit 40 can be integrated, and the design is helpful to the miniature and compacting development of the burner.

Furthermore, the turbocharged burner of the present disclosure in practice further comprises a control unit 50; the control unit 50 is installed with a control circuit 51, a lighter 52 correspondingly disposed in the interior of the burning chamber 22 and a fuel pump 53 coupled to the fuel tube 24 of each the nozzle 23, wherein the control circuit 51 is at least electrically connected to the lighter 52, the fuel pump 53, the turbocharger 30 and the motor 43 of the wind speed auxiliary unit 40.

Accordingly, the control circuit 51 of the control unit 50 can load or set the related work items and parameters, and according to the loaded or set work items and parameters, the control circuit 51 can control whether the lighter 52, the fuel pump 53, the turbocharger 30 and the motor 43 of the wind speed auxiliary unit 40 can operate or not, so as to achieve the objective of the automatic operation.

Figure 7:
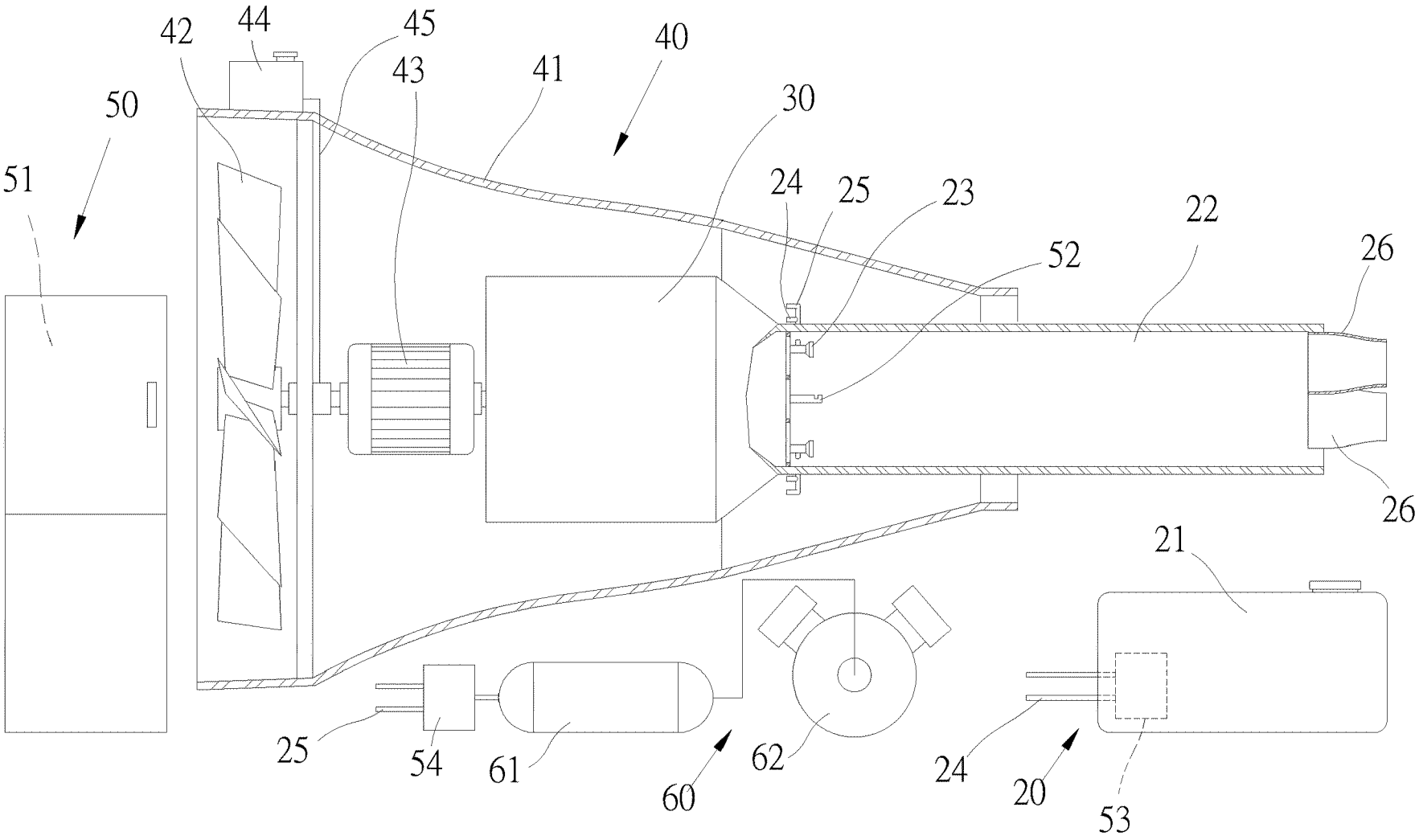
FIG. 7 is a sectional architecture diagram of a turbocharged burner according to a second embodiment of the present disclosure.

Referring to FIG. 7, the turbocharged burner of the present disclosure can further comprise a high-pressure gas supplying unit 60 and a control unit 50; the high-pressure gas supplying unit 60 is installed with a gas storage bucket 61 for storing a high-pressure gas, and each the nozzle 23 is installed with a high-pressure pipe 25 coupled to the gas storage bucket 61. The control unit 50 is installed with a control circuit 51, a lighter 52 correspondingly disposed in the interior of the burning chamber 22, a fuel pump 53 coupled to the fuel tube 24 of each the nozzle 23 and a throttle 54 coupled to the high-pressure pipe 25 of each the nozzle 23, wherein the control circuit 51 is at least electrically connected to the lighter 52, the fuel pump 53, the throttle 54, the turbocharger 30 and the motor 43 of the wind speed auxiliary unit 40.

In the embodiment, by further utilizing the high-pressure gas provided by the high-pressure gas supplying unit 60, the fuel entering the nozzle 23 is accelerating, and after the fuel passes the nozzle 23, the atomization effect is increased. Meanwhile, the gas fluid enter the burning chamber 22 is provided, and the objective of increasing the fuel burning efficiency is achieved.

As shown in the embodiment of FIG. 7, the burning unit 20 is installed with at least one jet pipe 26 disposed at a front end of the burning chamber 22, and preferably, a plurality of jet pipes 26 are disposed at the front ends of the burning chamber 22, wherein and a pipe diameter of each the jet pipe 26 is less than an inner diameter of the burning chamber 22. Under the reaction of the jet pipe 26, the burning time which the fuel is burned in the interior of the burning chamber 22 is extended, and the fire spurting distance which the fuel is burned is increased, so as to achieve the objective of increasing the thermal energy of burning the fuel.

In practice, the turbocharged burner further comprises the control unit 50. The control unit 50 is installed with a control circuit 51, a lighter 52 correspondingly disposed in the interior of the burning chamber 22 and a fuel pump 53 coupled to the fuel tube 24 of each the nozzle 23, the control circuit 51 is at least electrically connected to the lighter 52, the fuel pump 53, the turbocharger 30 and the motor 43 of the wind speed auxiliary unit 40. The burning unit 20 is installed with at least one jet pipe 26 disposed at a front end of the burning chamber 22, and in the present embodiment, a pipe diameter of each the jet pipe 26 is less than an inner diameter of the burning chamber 22.

Of course, in practice, the turbocharged burner of the present disclosure is implemented to further comprise a high-pressure gas supplying unit 60 and a control unit 50. The high-pressure gas supplying unit 60 is installed with a gas storage bucket 61 for storing a high-pressure gas, and each the nozzle 23 is installed with a high-pressure pipe 25 coupled to the gas storage bucket 61. The control unit 50 is installed with a control circuit 51, a lighter 52 correspondingly disposed in the interior of the burning chamber 22, a fuel pump 53 coupled to the fuel tube 24 of each the nozzle 23 and a throttle 54 coupled to the high-pressure pipe 25 of each the nozzle 23, wherein the control circuit 51 is at least electrically connected to the lighter 52, the fuel pump 53, the throttle 54, the turbocharger 30 and the motor 43 of the wind speed auxiliary unit 40. The burning unit 20 is installed with at least one jet pipe 26 disposed at a front end of the burning chamber 22, and in the present embodiment, a pipe diameter of each the jet pipe 26 is less than an inner diameter of the burning chamber 22.

According to the above possible embodiments of the present disclosure, the wind speed auxiliary unit 40 is installed with a lubricant bucket 44 for storing a lubricant and at least one lubricant pipe 45 coupled to the lubricant bucket 44 and a pivot setting location on a rotating axis of the motor 43 (i.e. the bearing location of the motor 43). By using the lubricant bucket 44 and the lubricant pipe 45 to usually provide the lubricant to the pivot setting location on the rotating axis of the motor 43, the motor 43 can operate successfully, and the entire operation efficiency of the turbocharged burner is increased.

Figure 8:
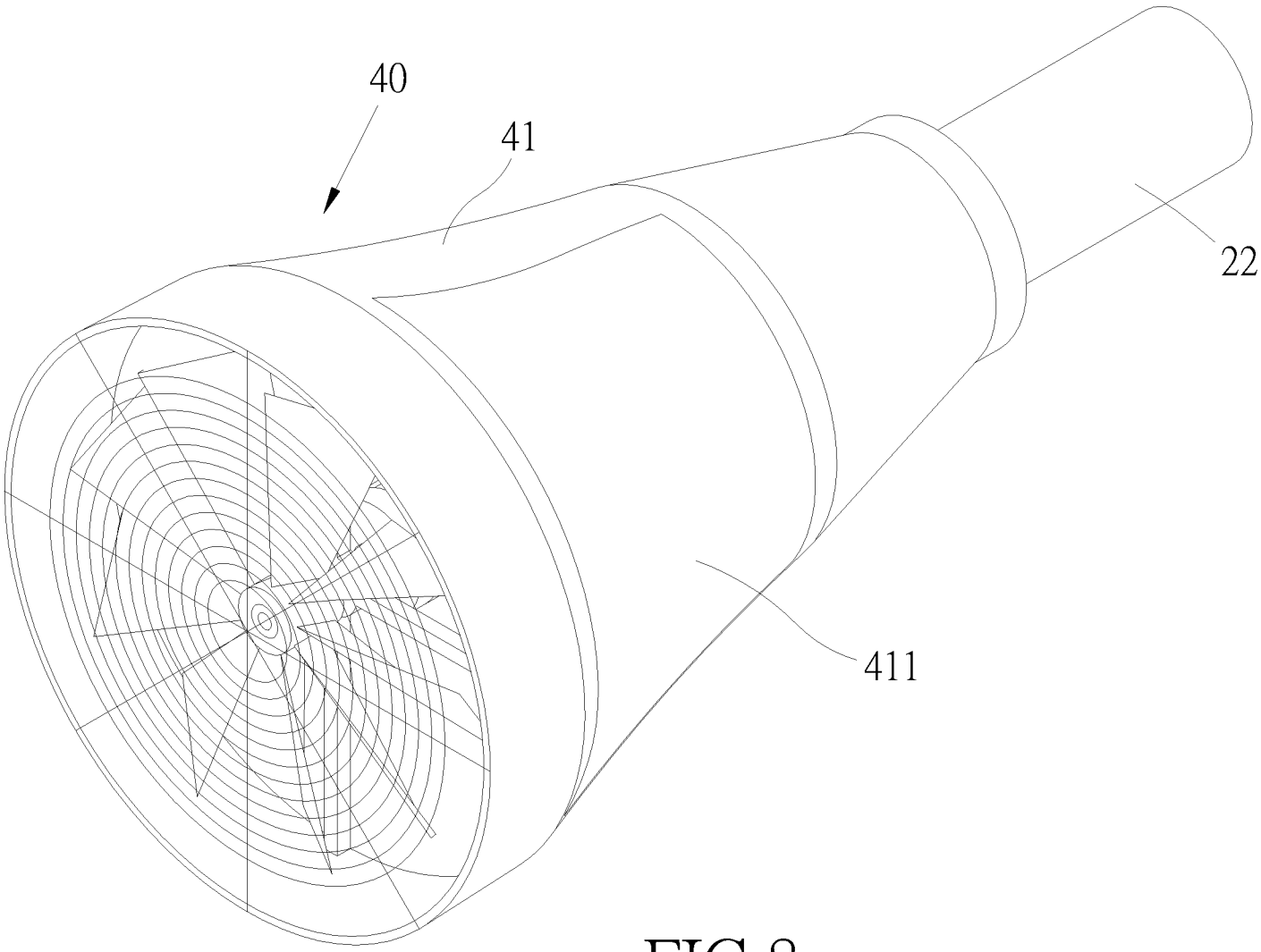
FIG. 8 is a three-dimensional outline diagram of a burning chamber and a wind speed auxiliary unit according to a third embodiment of the present disclosure.

Referring to FIG. 8, according to the above possible embodiments of the present disclosure, the wind speed auxiliary unit 40 is installed with at least one hatch cover 411 disposed at a tubular side of the wind speed bucket 41, wherein the hatch cover 411 is capable of opening and closing. By using the design of the hatch cover 411, the objective of conveniently checking and installing the related device and unit can be achieved.

Of course, in one preferably embodiment, the wind speed auxiliary unit 40 is installed with a lubricant bucket 44 for storing a lubricant, at least one lubricant pipe 45 coupled to the lubricant bucket 44 and a pivot setting location on a rotating axis of the motor 43 and at least one hatch cover 411 disposed at a tubular side of the wind speed bucket 41, wherein the hatch cover 411 is capable of opening and closing.

Furthermore, in one embodiment of the present disclosure which the turbocharger burner includes the control unit 50, the high-pressure gas supplying unit 60 is further installed with an air compressor 62 coupled to the gas storage bucket 61, and the air compressor 62 is electrically connected to the control circuit 51 of the control unit 50. Under the operation of the air compressor 62, the high-pressure gas is continuously provided.

The turbocharger burner of present disclosure can further comprise the control unit 50, and he high-pressure gas supplying unit 60 is further installed with an air compressor 62 coupled to the gas storage bucket 61. The air compressor 62 is electrically connected to the control circuit 51 of the control unit 50. The wind speed auxiliary unit 40 is installed with a lubricant bucket 44 for storing a lubricant and at least one lubricant pipe 45 coupled to the lubricant bucket 44 and a pivot setting location on a rotating axis of the motor 43.

The turbocharger burner of present disclosure can further comprise the control unit 50, and the high-pressure gas supplying unit 60 is further installed with an air compressor 62 coupled to the gas storage bucket 61. The air compressor 62 is electrically connected to the control circuit 51 of the control unit 50. The wind speed auxiliary unit 40 is installed with at least one hatch cover 411 disposed at a tubular side of the wind speed bucket 41, wherein the hatch cover 411 is capable of opening and closing.

Certainly, the turbocharger burner of present disclosure can further comprise the control unit 50, and in one preferably embodiment, the high-pressure gas supplying unit 60 is further installed with an air compressor 62 coupled to the gas storage bucket 61. The air compressor 62 is electrically connected to the control circuit 51 of the control unit 50, and the wind speed auxiliary unit 40 is installed with a lubricant bucket 44 for storing a lubricant, at least one lubricant pipe 45 coupled to a the lubricant bucket 44 and a pivot setting location on a rotating axis of the motor 43 and at least one hatch cover 411 disposed at a tubular side of the wind speed bucket 41, wherein the hatch cover 411 is capable of opening and closing.

Compared to the prior art, under the reaction of the turbocharger, the turbocharged burner disclosed by the present disclosure can increase the gas fluid of the burning chamber, so as to make the burning further entirely achieve the objective of increasing fuel burning efficiency; under the reaction of the wind speed auxiliary unit, partial flowing fluid is accelerated to pass the gap between the wind speed bucket and the turbocharger, the flowing speed of the gas fluid is accelerated and the flowing flux of the gas fluid is enhanced, so as to prevent the related device and unit from being affected by the high temperature; and by utilizing the design of the high-pressure gas supplying unit and the jet pipe, relatively positive and reliable means are provided to increase the burning efficiency and thermal energy of the fuel, in addition to reduce the contaminants generated by burning the diesel and heavy oil, it eases the alcohol to be the fuel, such that the turbocharged burner can be used in the restaurant, office, school and other indoor environment.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A turbocharged burner, at least comprising:

a burning unit and a turbocharger;

wherein the burning unit is installed with a fuel bucket for storing fuel and a burning chamber having a tubular shape, interior of the burning chamber is installed with at least one nozzle, at least one fuel tube coupled to the fuel bucket is disposed at each the nozzle; and the turbocharger is coupled to the burning chamber;

wherein the turbocharger is disposed at a rear end of the burning chamber, and a wind blowing direction of the turbocharger is parallel to an axis of the burning chamber;

wherein the turbocharged burner further comprises a wind speed auxiliary unit, the wind speed auxiliary unit is installed with a wind speed bucket at least covering exterior of the turbocharger, a front end and a rear end of the wind speed bucket are open, a gap for providing passage of a gas fluid is formed between the wind speed bucket and the turbocharger, the rear end of the wind speed bucket is installed with a blade and a motor for driving the blade to spin;

wherein the turbocharged burner further comprises a control unit; the control unit is installed with a control circuit, a lighter correspondingly disposed in the interior of the burning chamber and a fuel pump coupled to the fuel tube of each the nozzle, the control circuit is at least electrically connected to the lighter, the fuel pump, the turbocharger and the motor of the wind speed auxiliary unit.

2. The turbocharged burner according to claim 1, wherein the turbocharged burner further comprises: a high-pressure gas supplying unit; the high-pressure gas supplying unit is installed with a gas storage bucket for storing a high-pressure gas, and each the nozzle is installed with a high-pressure pipe coupled to the gas storage bucket; the control unit is further installed with throttle coupled to the high-pressure pipe of each the nozzle, the control circuit is further electrically connected to the throttle.

3. The turbocharged burner according to claim 1, wherein the burning unit is installed with at least one jet pipe disposed at a front end of the burning chamber, and a pipe diameter of each the jet pipe is less than an inner diameter of the burning chamber.

4. The turbocharged burner according to claim 2, wherein the burning unit is installed with at least one jet pipe disposed at a front end of the burning chamber, and a pipe diameter of each the jet pipe is less than an inner diameter of the burning chamber.

5. The turbocharged burner according to claim 1, wherein the wind speed auxiliary unit is installed with a lubricant bucket for storing a lubricant and at least one lubricant pipe coupled to the lubricant bucket and a pivot setting location on a rotating axis of the motor.

6. The turbocharged burner according to claim 1, wherein the wind speed auxiliary unit is installed with at least one hatch cover disposed at a tubular side of the wind speed bucket, wherein the hatch cover is capable of opening and closing.

7. The turbocharged burner according to claim 1, wherein the wind speed auxiliary unit is installed with a lubricant bucket for storing a lubricant, at least one lubricant pipe coupled to the lubricant bucket and a pivot setting location on a rotating axis of the motor and at least one hatch cover disposed at a tubular side of the wind speed bucket, wherein the hatch cover is capable of opening and closing.

8. The turbocharged burner according to claim 2, wherein the high-pressure gas supplying unit is further installed with an air compressor coupled to the gas storage bucket, and the air compressor is electrically connected to the control circuit of the control unit.

9. The turbocharged burner according to claim 2, wherein the high-pressure gas supplying unit is further installed with an air compressor coupled to the gas storage bucket, and the air compressor is electrically connected to the control circuit of the control unit; and the wind speed auxiliary unit is installed with a lubricant bucket for storing a lubricant and at least one lubricant pipe coupled to the lubricant bucket and a pivot setting location on a rotating axis of the motor.

10. The turbocharged burner according to claim 2, wherein the high-pressure gas supplying unit is further installed with an air compressor coupled to the gas storage bucket, and the air compressor is electrically connected to the control circuit of the control unit; and the wind speed auxiliary unit is installed with at least one hatch cover disposed at a tubular side of the wind speed bucket, wherein the hatch cover is capable of opening and closing.

11. The turbocharged burner according to claim 2, wherein the high-pressure gas supplying unit is further installed with an air compressor coupled to the gas storage bucket, and the air compressor is electrically connected to the control circuit of the control unit; the wind speed auxiliary unit is installed with a lubricant bucket for storing a lubricant, at least one lubricant pipe coupled to the lubricant bucket and a pivot setting location on a rotating axis of the motor and at least one hatch cover disposed at a tubular side of the wind speed bucket, wherein the hatch cover is capable of opening and closing.

12. The turbocharged burner according to claim 1, wherein the turbocharger is coupled to the burning chamber via a pipeline.

* * * * *